United States Patent [19]

Aso et al.

[11] Patent Number: 4,464,128

[45] Date of Patent: Aug. 7, 1984

[54] SEAL ARRANGEMENT BETWEEN AN OUTDRIVE UNIT AND A HULL OF A VESSEL

[75] Inventors: Kinichi Aso, Yawata; Kazuyoshi Shinada, Kaizuka, both of Japan

[73] Assignee: Yanmar Diesel Engine Company Ltd., Osaka, Japan

[21] Appl. No.: 320,691

[22] Filed: Nov. 12, 1981

[30] Foreign Application Priority Data

Dec. 3, 1980 [JP] Japan ..... 55-174043[U]

[51] Int. Cl.[3] ..... B63H 5/12

[52] U.S. Cl. ..... 440/112; 277/205; 277/212 FB

[58] Field of Search ..... 440/112, 54; 277/212 R, 277/212 C, 212 FB, 205; 441/94

[56] References Cited

U.S. PATENT DOCUMENTS 3,910,457 10/1975 Sutliff et al. ..... 441/94

FOREIGN PATENT DOCUMENTS 949239 2/1964 United Kingdom ..... 277/212 FB 1239228 7/1971 United Kingdom ..... 277/212 FB 1569661 6/1980 United Kingdom ..... 440/112

*Primary Examiner*—Sherman D. Basinger

*Attorney, Agent, or Firm*—Armstrong, Nikaido, Marmelstein & Kubovcik

[57] ABSTRACT

This invention discloses a seal arrangement between an outdrive unit and a hull of a vessel, comprising an outdrive unit connected to an engine and mounted on a bed of the hull, the outdrive unit projecting downward through an opening in the hull; a diaphragm seal fixed to the hull and the outdrive unit for sealing a space between the hull and the outdrive unit; an annular seal flange projecting above the diaphragm seal from the bed toward the outdrive unit; and a ring seal arranged between the outdrive unit and the seal flange for sealing a space therebetween; characterized in that; both ends of the ring seal are fastened to the outdrive unit and the seal flange, respectively. A water sensor connected to a warning device is arranged in a space between the diaphragm seal and the ring seal.

3 Claims, 3 Drawing Figures

SEAL ARRANGEMENT BETWEEN AN OUTDRIVE UNIT AND A HULL OF A VESSEL

BACKGROUND OF THE INVENTION

This invention relates to a seal arrangement between an outdrive unit and a hull of a vessel such as a sailing boat.

The applicant's U.K. Pat. No. 1,569,661 (sealing date Aug. 20, 1981) has disclosed a sealing arrangement shown in FIG. 1, wherein an outdrive unit 1 comprising an upper unit 2 and a lower unit 3 is shown in vertical section. An end of an input shaft 4 arranged in the upper unit 2 is connected to an engine (not shown), and the other end of the shaft 4 is connected to a drive shaft 5 through a dog clutch mechanism 6 operable between forward, neutral and reverse positions. The drive shaft 5 is connected to a propeller shaft 7 through a bevel gear mechanism 8 arranged in the lower end of the lower unit 3.

The outdrive unit 1 passes through an opening 10 in a hull 9 of a vessel, and is installed on an installation bed 11 of the hull 9 by means of pairs of brackets 12 with vibration isolating rubbers 13 or other vibration-proof means therebetween. The lower unit 3 projects downward and out of the hull 9 through the opening 10. An annular seal flange 14 is secured to the bed 9 by bolts (not shown). An outer edge of an annular rubber diaphragm seal 15 is pinched and secured between the flange 14 and the bed 9. The inner edge of the seal 15 is pinched and secured between the upper unit 2 and the lower unit 3. The seal 15 covers and seals the opening 10. A radially middle portion 15*a* of the seal 15 is bent and projects upward, whereby flexibility and damping effect are increased.

The radially inner portion of the flange 14 is situated above the diaphragm seal 15 and projects toward the outdrive unit 1. The seal flange 14 has a groove 14*a* at the inner edge thereof, into which a radially outer portion of a ring seal 16 having an inverse U-shaped section is fitted. The radially inner portion of the ring seal 16 is elastically pressed to the cylindrical surface of the outdrive unit 1. Thus, a double seal arrangement is performed by the diaphragm seal 15 and the ring seal 16.

In the above arrangement, since the lower diaphragm seal 15 has the bent portion 15*a* projecting upward (or downward), and therefore has sufficient elasticity, the vibration of the engine is not transmitted to the hull 9 through the diaphragm seal 15. However, since the outer portion of the ring seal 16 is engaged into the groove 14*a* in the flange 14, and the inner portion thereof is strongly pressed to the outdrive unit 1, the ring seal 16 has less elasticity, which results in a disadvantage that the vibration of the engine is transmitted to the hull 9 through the ring seal 16.

In order to dissolve the above disadvantage, the applicant has developed a structure shown in FIG. 2, which is not the invention. In FIG. 2, an annular lip 16*a* is formed at the inner edge of the ring seal 16 fitted into the groove 14*a* in the seal flange 14. The lip 16*a* is pressed to the outer surface of the outdrive unit 1. In this structure, when the outdrive unit 1 swings forward or rearward by thrust during forward driving or reverse driving, a part of the soft lip 16*a* is further compressed and deformed, and another part may be parted from the outdrive unit 1. Therefore the ring seal 16 may not function as sealing means.

Accordingly, it is an object of the invention to provide an improved seal arrangement, overcoming the above-noted disadvantages, wherein both ends of an upper ring seal are fastened to an outdrive unit and an inner edge of an annular seal flange, respectively.

Another object of the invention is to detect water entered into the space between the upper ring seal and a lower diaphragm seal by means of a water sensor arranged therebetween and connected to warning means, when the lower diaphragm seal is torn or cracked.

Other and further objects, features and advantages of the invention will appear more fully from the following description of the preferred embodiments of the invention.

DETAILED DESCRIPTION OF THE PREFERRED EMBODIMENT

Figure 1:
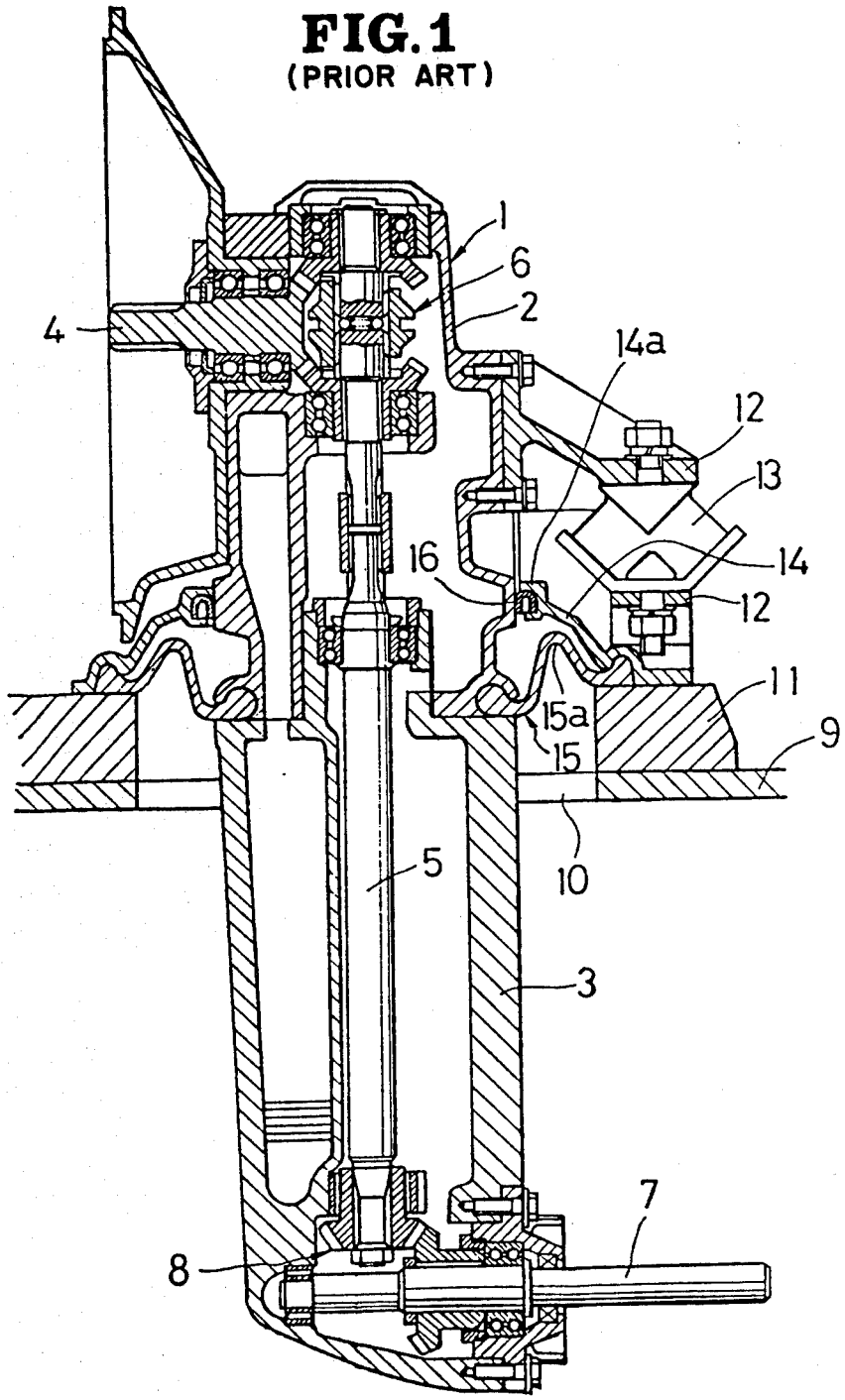
FIG. 1 (PRIOR ART)
FIG. 1 is a vertical section view of a known seal arrangement according to the applicant's U.K. Pat. No. 1,569,661.
Figure 2:
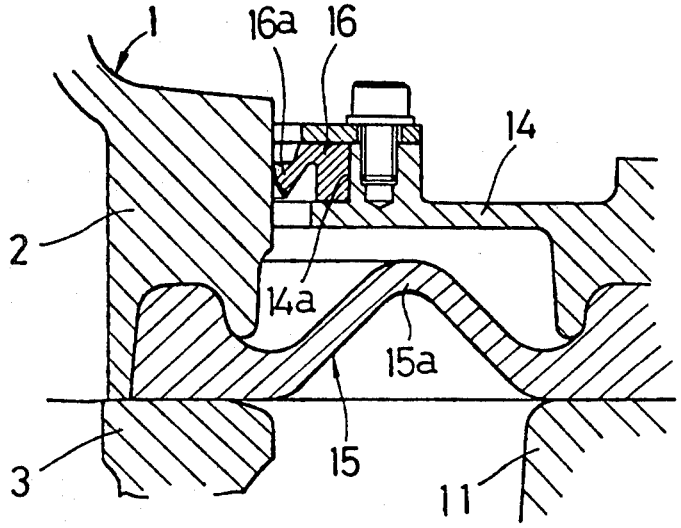
FIG. 2 is a fragmentary vertical section view of another seal arrangement developed by the applicant, which is not the invention.
Figure 3:
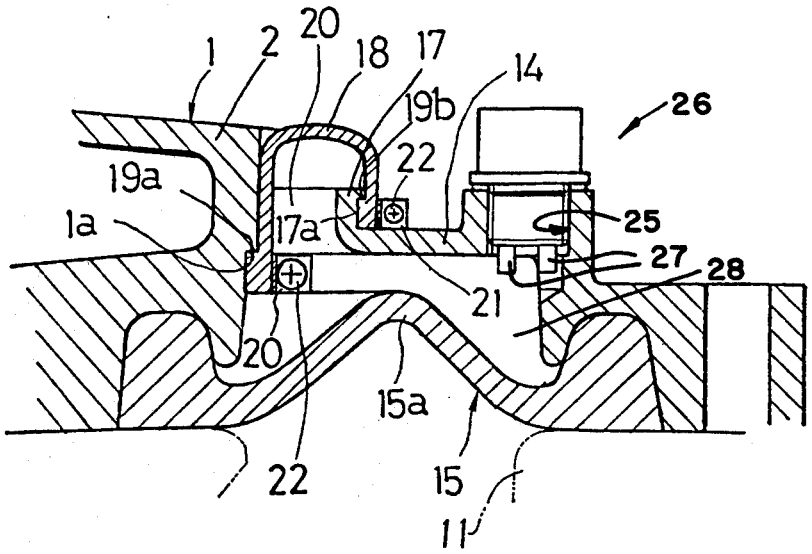
FIG. 3 is a fragmentary vertical section view of a seal arrangement according to the invention.

In FIG. 3, wherein members corresponding to those in FIGS. 1 and 2 bear like reference numerals, an annular seal flange 14 has an upward vertical end 17 of cylindrical form at the radially inner edge thereof around an outdrive unit 1. The surface 1*a* is formed at a position slightly below the position of the surface 17*a*. A thin ring stepped surface 17*a* faced downward is formed between the upper and lower parts of the cylindrical outer surface of the vertical end 17. A similar stepped surface 1*a* faced downward is formed at the outer surface of the outdrive unit 1. The surface 1*a l is formed at a position slightly below the position of the surface 17a.* A thin ring seal 18 of a diaphragm, which is made from rubber or other elastic material, has, for example, a substantially inverse U-shaped section or other section. The outer cylindrical wall of the ring seal 18 has an inner surface, at the lower end of which an annular stepped surface 19*b* faced upward is formed. The inner cylindrical wall of the ring seal 18 has an inner surface, at the lower end of which an annular stepped surface 19*a* faced upward is formed. The ends of the cylindrical walls of the ring seal 18 are fitted and fastened to the outer surfaces of the vertical end 17 and the outdrive unit 1 respectively by bands 21. The stepped surfaces 19*a* and 19*b* of the ring seal 18 are engaged to the stepped surfaces 1*a* and 17*a* of the outdrive unit 1 and the vertical end 17 of the seal flange 14, respectively. In this manner, a space 20 between the outdrive unit 1 and the seal flange 14 is sealed by the ring seal 18. Both ends of each fastening band 21 are set and connected together by set screws 22. Cloth for reinforcement may be arranged on or inside the surface of the ring seal 18. The lower diaphragm seal 15 has the required, sufficient strength. However, since the ring seal 18 is employed as an auxiliary, extremely high strength is not required for the ring seal 18. Therefore such ring seal 18 is preferably employed that is softer than the diaphragm seal 15, so that vibration may efficiently be absorbed.

The seal flange has a threaded hole 25 at the radially middle portion, into which electric water sensor 26 is screwed. The sensor 26 has two electric terminals 27 situated in a space 28 between the diaphragm seal 15 and the ring seal 18 as well as the seal flange 14. The sensor 26 is connected through amplifier circuit (not shown) to warning means such as a warning lamp (illuminant diode), a buzzer and/or the like mounted on an instrument panel in a control room.

As stated hereinbefore, since the ring seal 18 is fastened to the outdrive unit 1 and the seal flange 14, the outdrive unit 1 does not part from the ring seal 18, even when the outdrive unit 1 is swung by the thrust. Furthermore, since the ring seal 18 is of diaphragm type made from the elastic material, and the ends thereof are fixed to the unit 1 and the flange 14, the ring seal 18 has sufficient elasticity. Thus, the ring seal 18 can prevent the vibration of the engine and the outdrive unit 1 from being transmitted to the hull.

Further, according to the embodiment in FIG. 3, since the electric water sensor 26 connected to the warning means is arranged in the space 28 between the both seals 15 and 18, in the event of such accident that the lower seal 15 is torn or cracked and, therefore, water enters into the space 28, both terminals 27 are electrically connected to each other through the water. By this operation, the sensor 26 detects the entry of the water, and the warning means gives an alarm. Thus the safety and reliability can increase, because the cracked seal 15 can be exchanged before starting on a long cruise, and if not so, the ship can safely go on cruising to the nearest port with using the upper ring seal 18.

Said applicant's U.K. Pat. No. 1569661 has disclosed a water sensor having a float in a space between two seals. Such sensor of float type may be employed instead of the sensor 26 having the terminals 27 for detecting the entry of the water. However, the sensor of float type has large size, and furthermore, may give a misalarm when the float inclines during rolling and pitching. On the contrary, the sensor 26 in FIG. 3 has small size, and is not influenced by rolling and pitching. Therefore it is preferable to employ the sensor 26 in FIG. 3.

Although the invention has been described in its preferred form with a certain degree of particularity, it is understood that the present disclosure of the preferred form may been changed in the details of construction and the combination and arrangement of parts may be resorted to without departing from the spirit and scope of the invention as hereinafter claimed.

What is claimed:

1. A seal arrangement between an outdrive unit and a hull of a vessel, comprising:

an outdrive unit connectible to an engine and mounted on a bed of the hull with vibration-proof means therebetween, said outdrive unit projecting downwardly through an opening in the hull and having a circumferential stepped surface facing downwardly towards said opening;

a diaphragm seal fixed to the hull and the outdrive unit for selecting a space therebetween above said opening;

an annular seal flange above said diaphragm seal radially projecting from said bed toward said outdrive unit and having an inner edge and a cylindrical vertical upstanding end at the inner edge, said cylindrical upstanding end having an outer circumferential surface with an annula perpendicularly stepped surface at a position above said stepped surface of said outdrive unit;

a ring seal arranged between the outdrive unit and the seal flange for sealing a space therebetween above said diaphragm seal, said ring seal having a substantially inverse U-shape with a first depending leg and a second depending leg, each leg having an inner surface and an outer surface relative to a center line of the U, said first leg being longer than said second leg, said first leg having an annular stepped surface on a lower end of its outer surface engaging said circumferential stepped surface of said outdrive unit, said second leg having an annular stepped surface on a lower end of its inner surface engaging said annular perpendicularly stepped surface of said cylindrical upstanding end of said seal flange, and separate means for fastening said legs of said ring seal to the outdrive unit and the seal flange, respectively, said means for fastening said first leg to said outdrive unit being positioned at a position below the position of said means for fastening said second leg to said seal flange, said means for fastening said first leg engaging the inner surface thereof, said means for fastening said second leg engaging said outer surface thereof.

2. A seal arrangement of claim 1, wherein a sensor means for sensing current flow through water is arranged in a space between the diaphragm seal and the ring seal.

3. A seal arrangement of claim 2, wherein said sensor means has a pair of spaced apart, fixed electric terminals projecting into the space between the seals, so that seawater entered into the space may be detected by flow of current between the terminals.

* * * * *